US008169859B1

(12) United States Patent
Sheehan

(10) Patent No.: US 8,169,859 B1
(45) Date of Patent: May 1, 2012

(54) ANIMAL CLOCK ASSEMBLY

(76) Inventor: James Sheehan, Glens Falls, NY (US)

( * ) Notice: Subject to any disclaimer, the term of this patent is extended or adjusted under 35 U.S.C. 154(b) by 782 days.

(21) Appl. No.: 12/264,851

(22) Filed: Nov. 5, 2008

(51) Int. Cl.
*G04B 19/00* (2006.01)
*G04B 19/02* (2006.01)

(52) U.S. Cl. ..... 368/76; 368/78; 368/222; 368/223; D10/7

(58) Field of Classification Search ..... 368/10, 368/45, 88, 276–278, 285, 316–317, 40, 368/76, 78, 220, 222, 235; 248/116; D10/7
See application file for complete search history.

(56) References Cited

U.S. PATENT DOCUMENTS

| | | | | | |
|---|---|---|---|---|---|
| 268,890 | A | * | 12/1882 | Hills | 368/317 |
| 1,420,583 | A | * | 6/1922 | Simons | 248/116 |
| 1,475,137 | A | * | 11/1923 | Oppenheim | 248/116 |
| D144,399 | S | * | 4/1946 | Levitan | D10/7 |
| D169,947 | S | * | 6/1953 | Punzak | D10/7 |
| D181,344 | S | * | 11/1957 | Delpidio | D10/7 |
| 3,191,901 | A | * | 6/1965 | Green | 248/116 |
| 3,444,685 | A | * | 5/1969 | Juillerat | 368/276 |
| 4,006,586 | A | * | 2/1977 | Casella | 368/285 |
| D243,950 | S | * | 4/1977 | Ogasawara | D19/64 |
| D245,673 | S | * | 9/1977 | Bartlett | D10/7 |
| 4,725,061 | A | * | 2/1988 | Gross | 273/157 R |
| 4,730,284 | A | * | 3/1988 | Adams | 368/72 |
| 4,742,500 | A | * | 5/1988 | Luce | 368/10 |
| 5,684,758 | A | * | 11/1997 | Gray et al. | 368/10 |
| 5,850,995 | A | * | 12/1998 | Lin | 248/116 |
| 5,888,117 | A | * | 3/1999 | Sutton | 446/267 |
| 6,116,775 | A | * | 9/2000 | Masateru | 368/285 |
| D474,120 | S | * | 5/2003 | McLemore et al. | D10/40 |
| 7,298,284 | B2 | * | 11/2007 | Glime | 340/691.1 |

* cited by examiner

*Primary Examiner* — Vit Miska

(57) ABSTRACT

A clock assembly having a primary body in the shape of a type of animal. The primary body has a front face and a back face, and the secondary body has a front portion and a back portion. The primary and secondary bodies each have substantially circular openings with inner surfaces that are configured for selective receipt of a clock. At least a portion of the secondary body is secured to at least a portion of the secondary body, such that when the primary body and the secondary body are secured together, the substantially circular openings of the primary and secondary bodies are flush with one another. The clock assembly has at least one eyepiece. The outer surface of a clock having a clock display and a housing is mounted inside the inner surface of the opening of the primary body and the inner surface of the opening of the secondary body.

10 Claims, 6 Drawing Sheets

12
12a
14
16
12b
14a
20a
20
18a
18
10

ANIMAL CLOCK ASSEMBLY

FIELD OF THE INVENTION

The present invention pertains to the field of clocks. More particularly, the present invention relates to an animal clock assembly.

BACKGROUND

The purpose of this invention is to provide an educational animal clock assembly which may be used to tell time, to help children learn the names and colors of animals and to match shapes. The animal clock assembly described herein is designed for children, but may also be used by adults.

Without limiting the scope of the invention, a brief summary of some of the claimed embodiments of the invention is set forth below. Additional details of the summarized embodiments of the invention and/or additional embodiments of the invention may be found in the Detailed Description.

SUMMARY

A clock assembly is provided herein having a primary body that has the shape of a type of animal. The body has a front face, a back face, and an opening within the body, extending therein from the front face to the back face, having an inner surface configured for selective receipt of a clock. The assembly has a base that has at least one recess that is configured for selective receipt of at least a portion of the primary body. The assembly also has a secondary body that has a front portion, a back portion and an opening within the body having an inner surface. At least a portion of the secondary body is secured to at least a portion of the primary body, such that when the primary body and the secondary body are secured together, the inner surface of the primary body opening and the inner surface of the secondary body opening are flush with one another. The assembly has at least one eyepiece that is secured to at least a portion of either the primary body or the secondary body. The assembly also has a clock that has a clock display and a housing having an outer surface. The housing is mounted inside of the inner surface of the primary body opening such that the outer surface of the housing is in contact with the inner surface of the primary and secondary body openings.

BRIEF DESCRIPTION OF THE SEVERAL VIEWS OF THE DRAWINGS

The foregoing purposes and features, as well as other purposes and features, will become apparent with reference to the description and accompanying figures below, which are included to provide an understanding of the invention and constitute a part of the specification, in which like numerals represent like elements, and in which.

DETAILED DESCRIPTION

Figure 1:
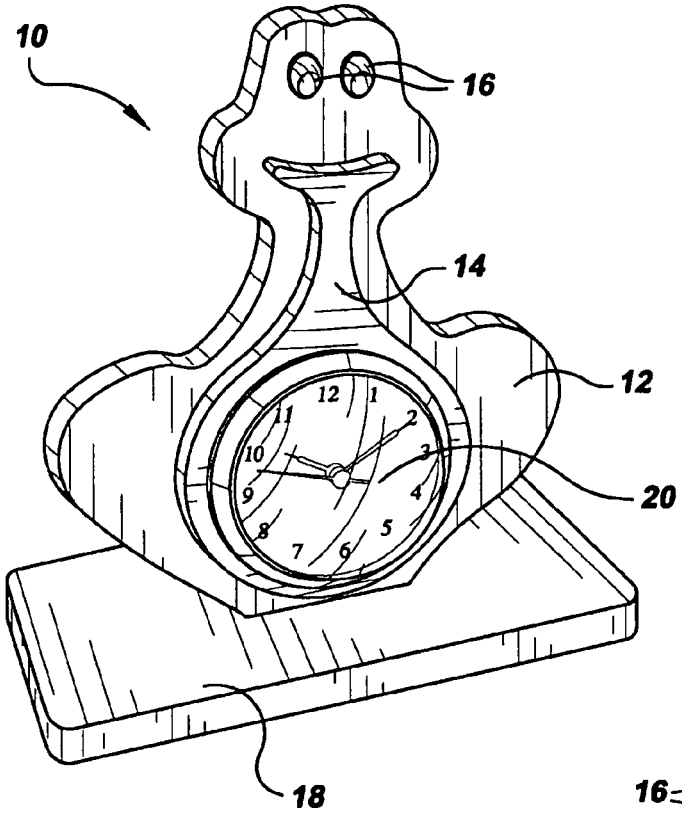
FIG. 1 illustrates a perspective view of a first embodiment of the animal clock assembly.

The following detailed description should be read with reference to the drawings, in which like elements in different drawings are identically numbered. The drawings, which are not necessarily to scale, depict selected preferred embodiments and are not intended to limit the scope of the invention. The detailed description illustrates by way of example, not by way of limitation, the principles of the invention.

The skilled artisan will readily appreciate that the animal clock assemblies described herein are merely exemplary and that variations can be made without departing from the spirit and scope of the invention. It is also to be understood that the terminology used herein is for the purpose of describing particular embodiments only and is not intended to be limiting.

Referring now in detail to the drawings, in which like reference numerals indicate like parts or elements throughout the several views, in various embodiments, and referring to FIGS. 1-12, presented herein is an exemplary animal clock assembly.

Figure 2:
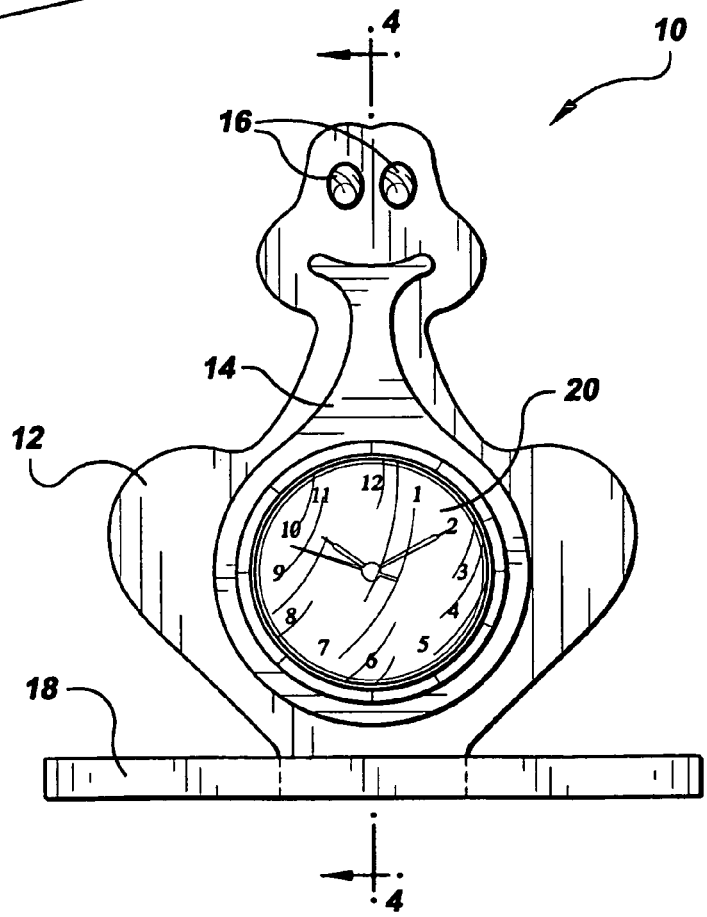
FIG. 2 illustrates a front view of the animal clock assembly of FIG. 1.
Figure 3:
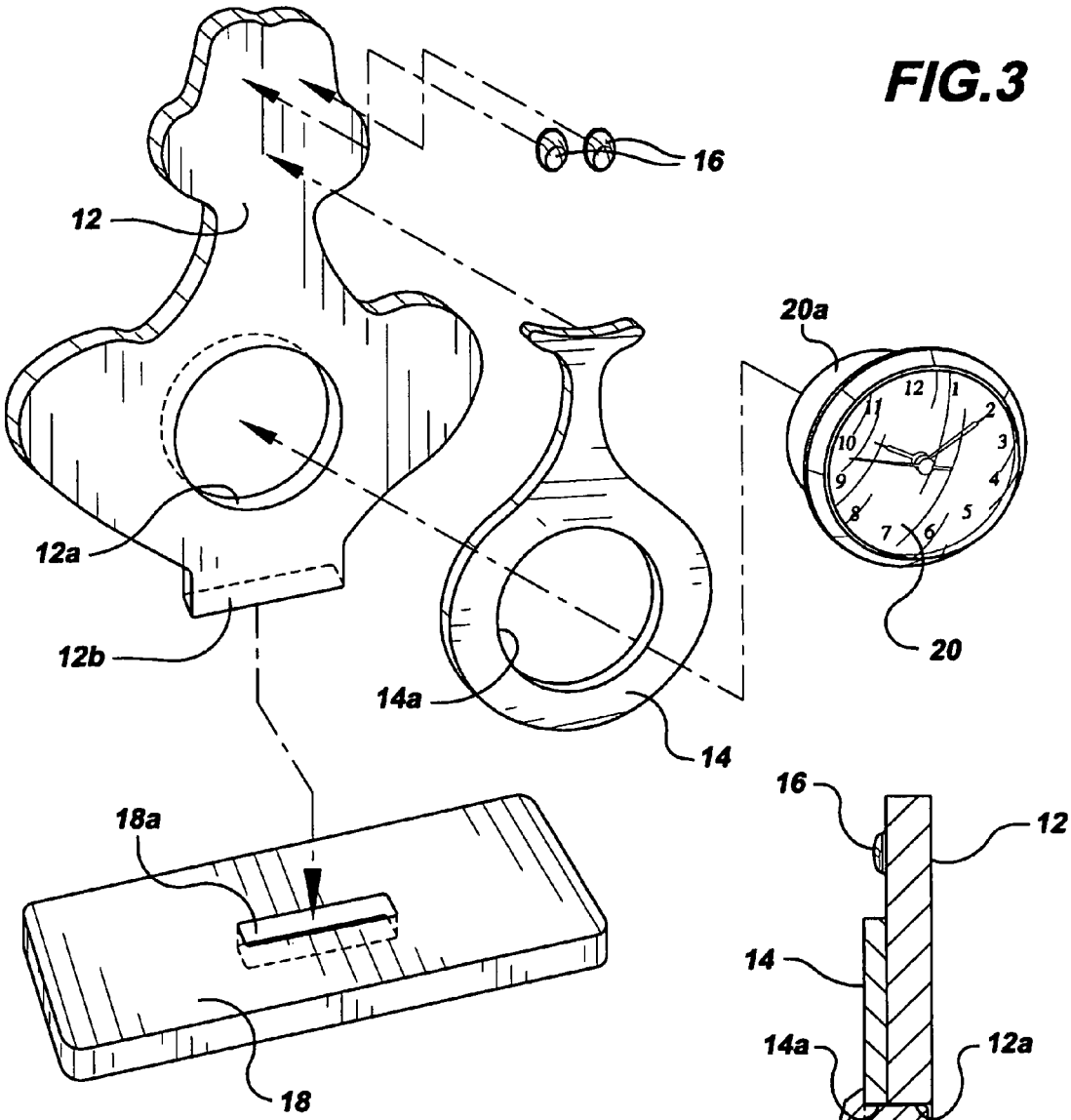
FIG. 3 illustrates an exploded perspective view of the animal clock assembly of FIG. 1.

In one exemplary aspect, FIGS. 1-4 illustrate one embodiment of the animal clock assembly 10. In the illustrated embodiment the animal clock assembly 10 has the overall appearance and general shape of a frog. In other exemplary aspects, the animal clock assembly 10 may have the overall appearance and shape of any other animal (i.e., a dog, cat, rabbit, bear, etc.) or any other shape or appearance, preferably which is appealing to children. As illustrated in FIGS. 1-2, the animal clock assembly 10 has a primary body 12. In one aspect, the primary body 12 may be in the general animal shape of a frog. The assembly 10 may also have a secondary body 14, a base 18 having a recess 18*a*, at least one eyepiece 16, and a clock 20. Clock 20 has a housing with an outer surface 20*a* and a clock display 20 with a standard clock face having a minute hand and an hour hand, for telling time. Quartz TimeZone™ clocks may be used in the animal clock assembly, although any suitable commercially available clock may be used. In one aspect, the clock 20 may comprise an alarm. Although not shown herein, in one aspect, the primary body 12 may be green in color to represent the color of a frog, and the secondary body 14 may be white in color. As illustrated in FIG. 3, the primary body 12 has a bottom portion 12*b* and an opening, extending therein from the front face to the back face, having an inner surface 12*a*. The secondary body 14 has an opening having an inner surface 14*a*. In one aspect, the openings of the primary and secondary bodies have inner surfaces 12*a*, 14*a* configured for selective receipt of a clock.

Figure 4:
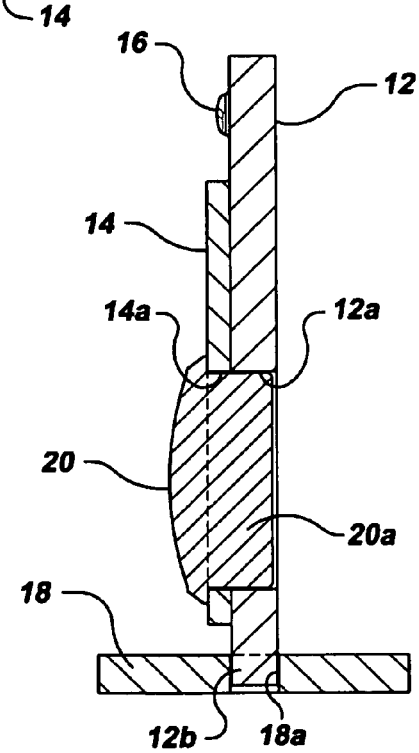
FIG. 4 is a cross sectional view of the animal clock assembly taken along line 4-4 of FIG. 2.
Figure 5:
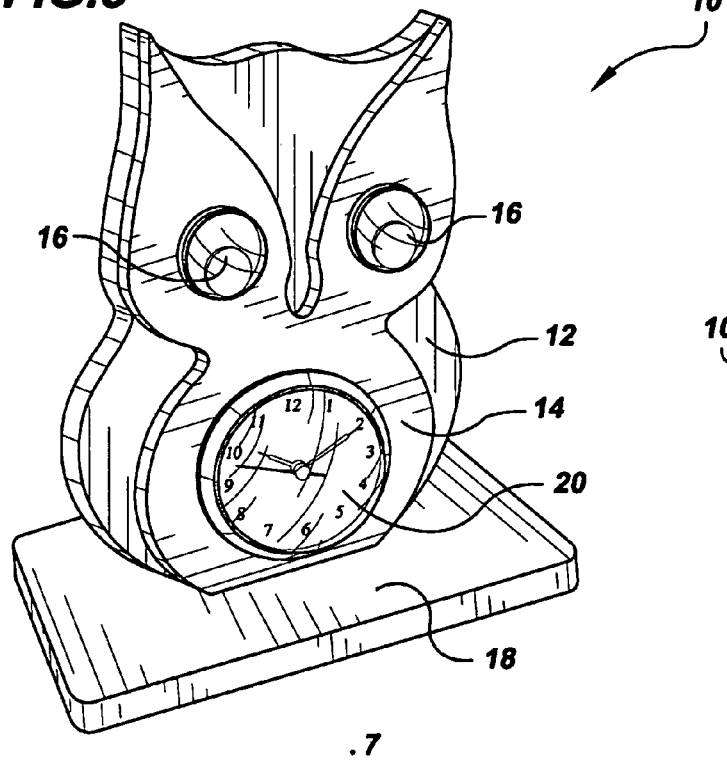
FIG. 5 illustrates a perspective view of a second embodiment of the animal clock assembly.
Figure 6:
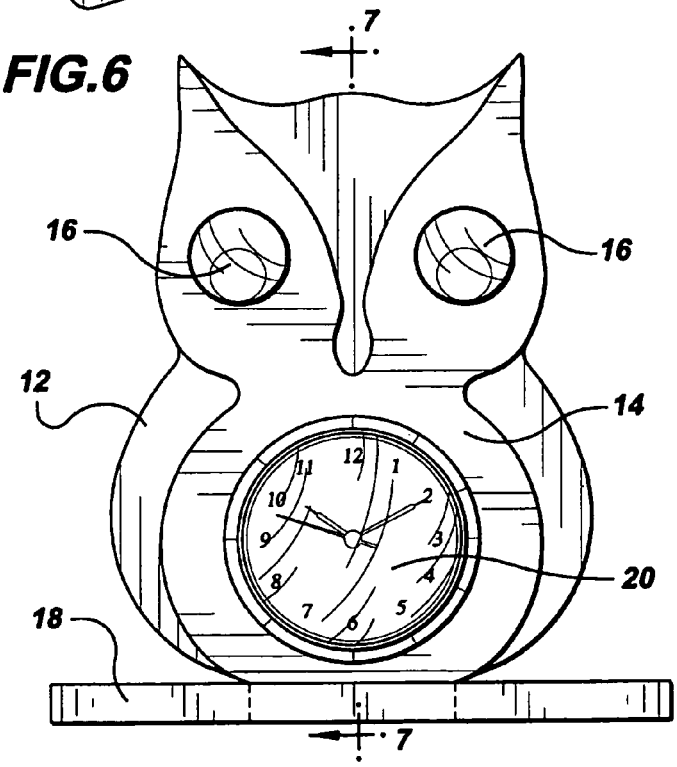
FIG. 6 illustrates a front view of the animal clock assembly of FIG. 5.
Figure 7:
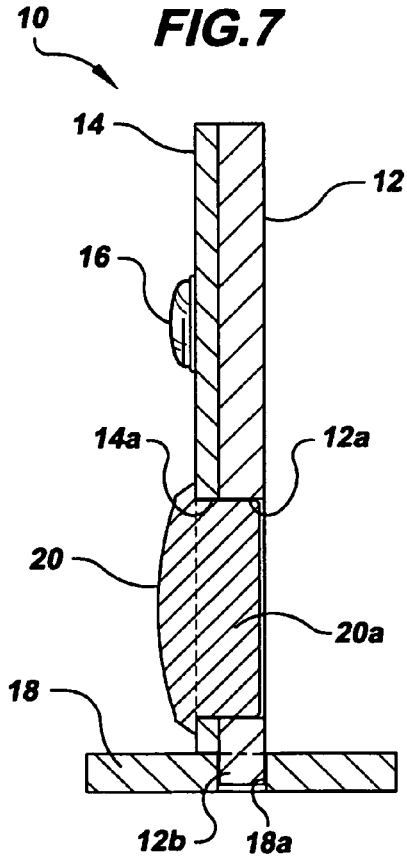
FIG. 7 illustrates a cross-sectional view of the animal clock assembly of FIG. 5.
Figure 8:
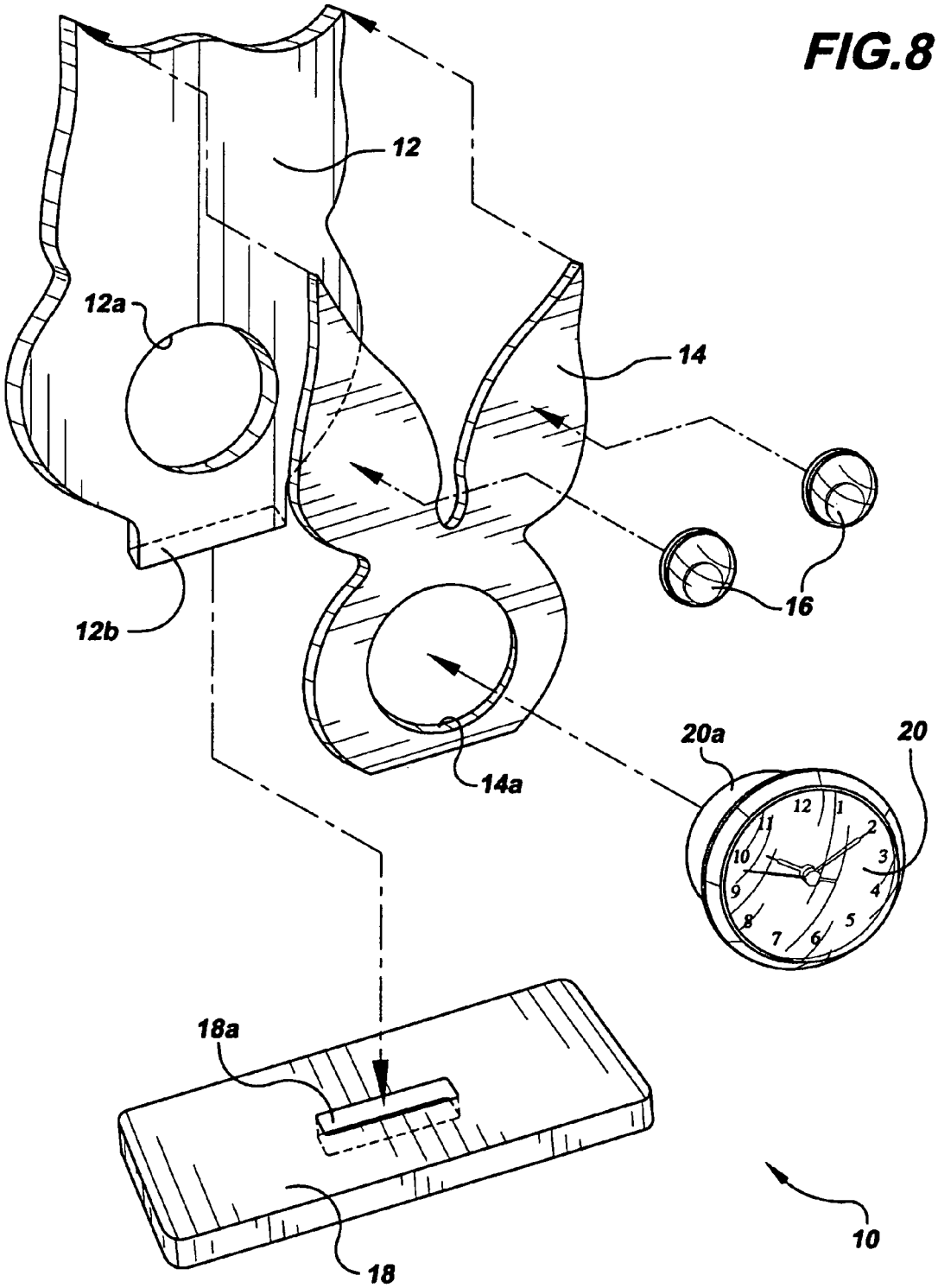
FIG. 8 illustrates an exploded perspective view of the animal clock assembly of FIG. 5.
Figure 9:
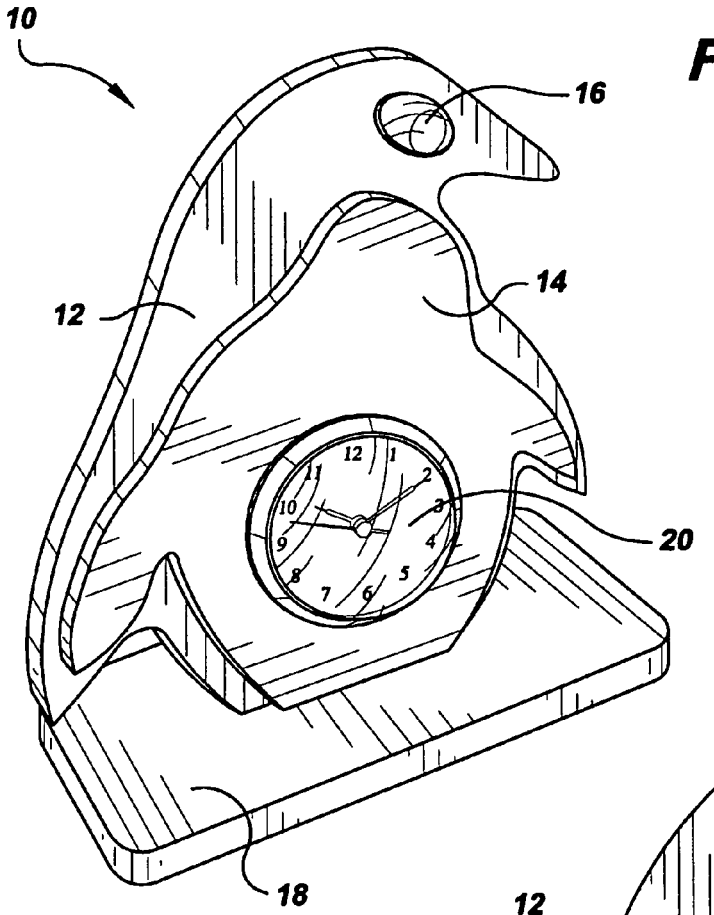
FIG. 9 illustrates a perspective view of a third embodiment of the animal clock assembly.
Figure 10:
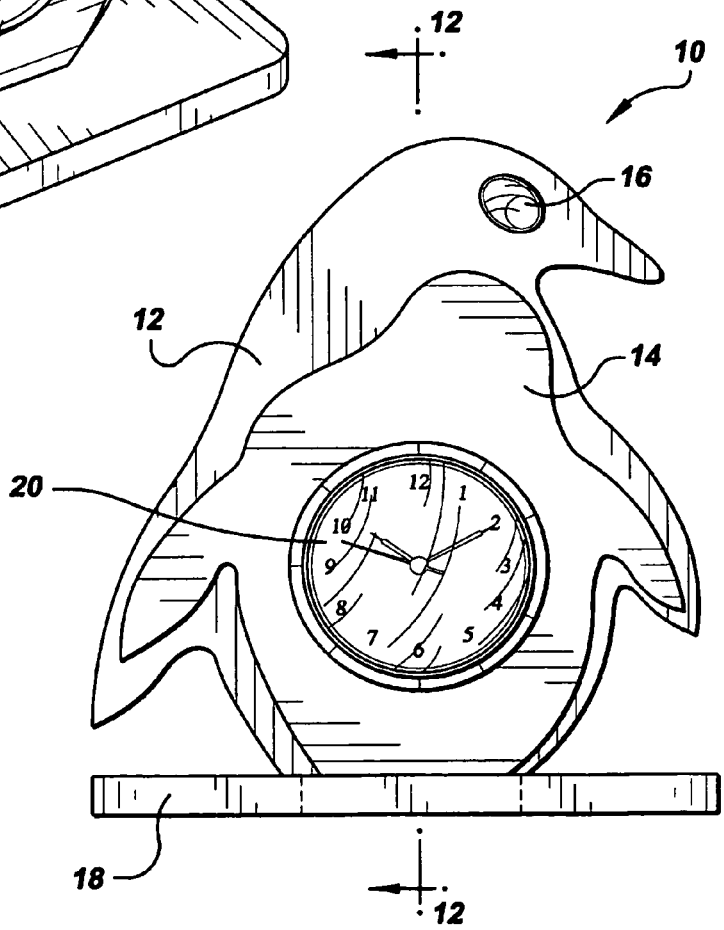
FIG. 10 illustrates a front view of the animal clock assembly of FIG. 9.
Figure 11:
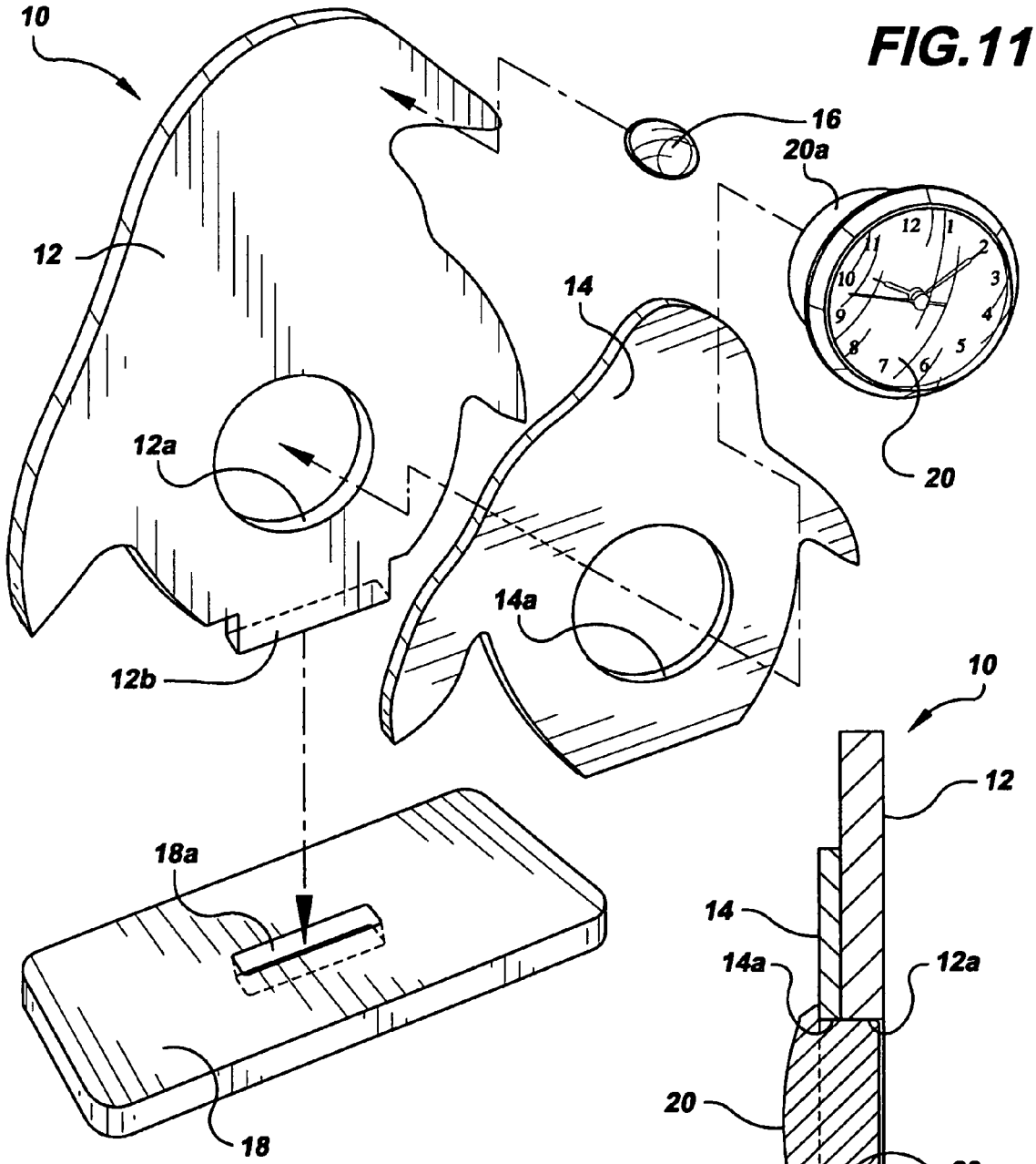
FIG. 11 illustrates an exploded perspective view of the animal clock assembly of FIG. 9.
Figure 12:
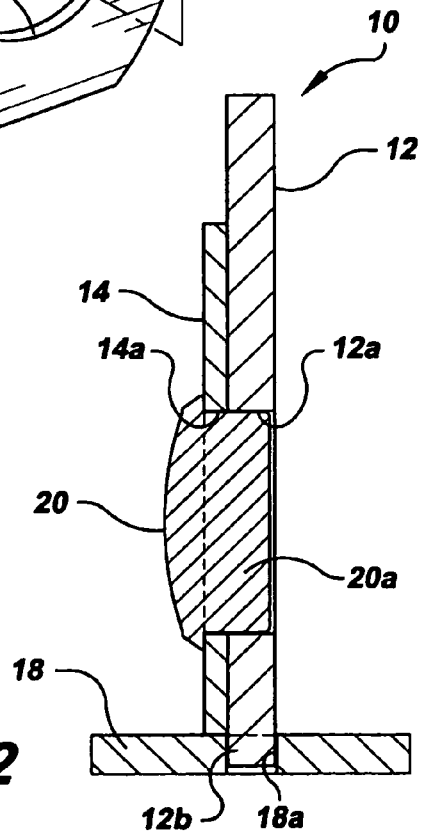
FIG. 12 illustrates a cross sectional view of the animal clock assembly taken along line 4-4 of FIG. 10.

In one aspect, the body 12 has a front face and a back face and an outer rim positioned between the front face and the back face. The secondary body 14 has a front portion, a back portion, and an outer rim positioned between the front portion and the back portion of the secondary body 14. In one aspect, the animal clock assembly 10 may be pre-assembled. In the assembled state, as illustrated in FIGS. 1 and 2, at least a portion of the primary body 12 is secured to at least a portion of the secondary body 14. In one exemplary aspect, the front face of the primary body 12 is secured to the back portion of the secondary body 14. In one aspect, the front face of the primary body 12 and the back face of the secondary body 14 are secured by an adhesive, such as, but not limited to an epoxy, super glue, plastic glue, and the like. As illustrated in FIG. 4, when the primary body 12 and secondary body 14 are secured together, they are aligned such that the inner surface 12*a* of the primary body 12 opening is flush with the inner surface 14*a* of the secondary body 14 opening, and the inner surfaces 12*a* and 14*a* form a continuous opening. In one aspect, both the inner surface 12*a* of the primary body 12 and the inner surface 14*a* of the secondary body 14 have openings that are substantially circular in shape. In other exemplary aspects, one of ordinary skill in the art would recognize that any other suitable shape may be used.

After the primary body 12 and secondary body 14 are secured together, clock 20 is mounted inside of the inner surfaces 12*a* and 14*a* of the primary body 12 and secondary body 14, respectively, such that the outer surface 20*a* of the clock housing forms an interference fit with the inner surfaces 12*a* and 14*a* of the primary body 12 and the secondary body 14, respectively, and an inner surface of an outer rim of the clock display 20 is positioned such that it rests against the front portion of the secondary body 14, when the clock assembly 10 has been assembled. Both of the inner surfaces 12*a* and 14*a* are configured to receive the outer surface 20*a* of the clock housing. In one aspect, the outer surface 20*a* of the clock housing may be secured to the inner surfaces 12*a*, 14*a* using a non-adhesive snap-fit configuration. In one aspect, the clock 20 may be secured to the inner surfaces 12*a*, 14*a* using an adhesive, such as, but not limited to, an epoxy resin, glue, super glue, plastic glue, or any other suitable type of adhesive.

As illustrated in FIGS. 1 and 2, in the assembled state, the bottom portion 12*b* of the body 12 is securely positioned in the recess 18*a* of the base 18, such that the bottom portion 12*b* forms an interference fit with the recess 18*a*. In one aspect, the bottom portion 12*b* may be secured to the recess 18*a* using an adhesive, such as, but not limited to, an epoxy resin, a glue, a super glue, a plastic glue, and the like. When the bottom portion 12*b* of the animal clock body 12 is secured to the recess 18*a* of the base 18, the body 12 forms a substantially perpendicular angle with the base 18, as illustrated in FIG. 4.

In one aspect, the animal clock assembly 10 has at least one eyepiece 16 that is secured to the front face of the animal clock primary body 12, such as that illustrated in FIGS. 1 through 4. In another aspect, the animal clock assembly 10 may have two eyepieces 16 that may be positioned adjacent to one another in a parallel manner. In one aspect, the at least one eyepiece may be secured to at least a portion of at least one of the primary body 12 or the secondary body 14. In another aspect, the at least one eyepiece 16 may be secured to the front face of the primary body 12 in any desirable position or manner. In one aspect, the at least one eyepiece 16 may be secured to the front face of the primary body 12 using an adhesive, such as, but not limited to, an epoxy resin, a glue, a super glue, a plastic glue, and the like. As illustrated in FIG. 4, in one aspect, the at least one eyepiece 16 may be positioned such that it is located in the vicinity of the head of the type of animal shape. In the embodiment illustrated in FIGS. 1-4, the at least one eyepiece 16 is secured to the front face of the body 12 such that the at least one eyepiece 16 is positioned above the secondary body 14 and the clock 20. In one aspect, any commercially available eyepiece may be used.

The animal clock assembly 10 can be made of any suitable material. In one aspect, the bodies 12, 14 and base 18' are composed of polyethylene. In one aspect, the primary body 12, secondary body 14, and base 18 of the animal clock assembly 10 may be made of any suitable plastic material. In another aspect, the animal clock assembly 10 may be sold in a kit and may be packaged in a Styrofoam container, for example, such that the components of the animal clock assembly 10 may be removed and assembled by a child or other user, upon opening the packaged kit. In this aspect, the animal clock assembly 10 may comprise a Velcro® material or other suitable material that is positioned in the vicinity of the front face of the head of the primary body 12 of the type of animal and on a back side of the eyepiece 16 to allow a user to removably attach the at least one eyepiece 16 to the front face of the primary body 12. The front face of the primary body 12 and the back portion of the secondary body 14 may also comprise a Velcro® material or other suitable material to allow a user to removably attach the front face of the body 12 and the back portion of the body 14 to each other. In one aspect, bottom portion 12*b* of the primary body 12 may be inserted by a user into the recess 18*a* of the base 18 in a snap-fit configuration, such that an interference fit is formed. In another aspect, the outer surface 20*a* of the housing of the clock 20 may be inserted into the combined opening of the primary body 12 and the secondary body 14 using a snap-fit method, such that the clock 20 forms an interference fit with the inner surface 12*a* of the primary body 12 and the inner surface 14*a* of the secondary body 14 of the animal clock assembly 10.

In exemplary one aspect; and not meant to be limiting, the primary body 12 of the animal clock assembly 10 illustrated in the first embodiment of FIGS. 1 through 4, is between approximately 6.5 and 7 inches in height In one aspect, the animal clock may be approximately 6.8 inches in height. In one aspect, the animal clock in the first embodiment may be approximately 5.5 inches in width at the widest point of the primary body 12. In one aspect, the inner surface 12*a* of the primary body and the inner surface 14*a* of the secondary body 14 each define openings with a diameter of approximately 2.25 inches, such that they form a continuous, flush opening when secured together, as described above. In one aspect, the openings are substantially circular in shape. In one aspect, the base 18 of the animal clock assembly may be between 6.5 and 7 inches wide. In another aspect, the base 18 of the animal clock assembly 10 may be approximately 6.8 inches wide. In another aspect, the base 18 of the animal clock assembly 10 may be between approximately 3.25 and 3.75 inches wide. In one aspect, the base of the clock may be approximately 3.5 inches in width and approximately 0.5 inches in height. In one aspect the recess 18*a* may be approximately 2 inches in width. In one aspect, recess 18*a* may be approximately 0.5 inches in width. In one aspect, two holes may be drilled in the bottom of the recess 18*a* of the base 18 to allow for further positioning of the bottom portion 12*b* in the recess 18*a*.

In the embodiment illustrated in FIGS. 1 through 4, the at least one eyepiece 16 may be approximately 0.375 inches in width and approximately 0.5 inches in height. In one aspect, the primary body 12 may have two eyepieces 16 that are spaced approximately 0.125 inches apart. In one aspect, the bottom portion 12*b* of the primary body 12 in the embodiment described in FIG. 1 is approximately 1.75 inches in width. In one aspect, any suitable commercial clock, as described above, may be selected such that the clock face 20 is between approximately 2.5 and 3 inches in width. In one aspect, the width of the clock face 20 may be approximately 2.75 inches. In one aspect, a rubber ring (not shown) may be placed around the outer surface of the housing 20*a* to enhance the fit between the clock housing 20*a* and the inner surfaces 12*a*, 14*a* of the primary body 12 and the secondary body 14.

A second embodiment of the animal clock assembly 10 is illustrated in FIGS. 5-8. In this embodiment, the animal clock assembly 10 is identical to the animal clock assembly 10 described in the first embodiment except that the animal clock assembly 10 of this embodiment has the overall appearance and shape of an owl. As illustrated in FIGS. 5-8, the animal clock assembly 10 has a primary body 12 in the general animal shape of an owl, a secondary body 14 also in the shape of an owl, a base 18 with a recess 18*a*, at least one eyepiece 16, and a clock 20 with a clock housing 20*a*. Although not shown herein, in one aspect, the primary body 12 may be red in color to represent the color of a type of owl, and the secondary body 14 may be white in color to represent underside of a type of owl. As described above, the animal clock assembly 10 of this embodiment has identical components and dimensions and an identical assembly as the frog clock embodiment described above, except that the primary body 12 in the second embodiment is approximately 5 inches in width at its widest portion and between approximately 6 and 7 inches in height, and the secondary body 14 is approximately 4 inches at its widest portion and between approximately 6 and 7 inches in height, respectively. In one exemplary aspect, the at least one eyepiece 16 of this embodiment may be approximately 0.875 inches in diameter. The at least one eyepiece 16 is secured to at least a portion of the secondary body 14 such that it is located in the vicinity of the head of the animal shape of the secondary body 14 above the clock 20.

A third embodiment of the animal clock assembly 10 is illustrated in FIGS. 9-12. In this embodiment, the animal clock assembly 10 has identical components and general assembly as the animal clock assembly 10 described in the first and second embodiments, except that the animal clock assembly 10 of this embodiment has the overall appearance and shape of a penguin. As illustrated in FIGS. 9-12, in one aspect, the animal clock assembly 10 has a primary body 12 in the general animal shape of a penguin, a secondary body 14 in the shape of a penguin's breast and arms, a base 18 with a recess 18*a*, at least one eyepiece 16, and a clock 20. Although not shown herein, in one aspect, the primary body 12 may be black in color to represent the color of a penguin, and the secondary body 14 may be white in color to represent a penguin's white underside. As described above, the animal clock assembly 10 of this embodiment has identical components and dimensions and an identical assembly as the frog clock embodiment described above, except that the primary body 12 is approximately 6.5 inches in width at its widest portion, and the secondary body 14 is approximately 6 inches in width at its widest portion and approximately 5.5 inches in height, respectively. The at least one eyepiece 16 of this embodiment is approximately 0.625 inches in diameter. In one aspect, the at least one eyepiece 16 is secured to at least a portion of the primary body 12 such that it is located in the vicinity of the head of the type of animal shape of the primary body 12 above the clock 20.

The animal clock assembly 10 of the present invention is beneficial because it may be used to teach children how to tell time, and it can be used to teach children the names of animals, such as, but not limited to, for example, a frog, an owl, a penguin, and the like. The animal clock assembly 10 herein may also be used to teach children the colors of different animals. In one aspect, for example, the animal clock assembly 10 of FIGS. 1-4 may be used to teach a child to tell time, the name "frog", and that a frog can be "green" in color. In another aspect, for example, the animal clock assembly illustrated in FIGS. 5-8 may be used to teach a child to tell time, the name "owl", and that an owl can be "red" in color. In yet another exemplary aspect, and not meant to be limiting, the animal clock assembly illustrated in FIGS. 9-12 may be used to teach a child to tell time, the name "penguin", and that a penguin can be "black" in color, with a "white" front body portion. In another aspect, the non-assembled animal clock assembly 10, such as described herein in FIGS. 3, 8, and 11 may also be useful for challenging children to match shapes together to produce the assembled components of the animal clock assembly 10.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". The words "including" and "having," as used herein including the claims, shall have the same meaning as the word "comprising." Those familiar with the art may recognize other equivalents to the specific embodiments described herein, which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g., each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below. Having thus described preferred embodiments of the present invention, it will be understood that various modifications or alterations can be made to the above described embodiments, including changing dimensions of the various components, without departing from the spirit and scope of the invention.

This completes the description of the selected embodiments of the invention. Those skilled in the art may recognize other equivalents to the specific embodiments described herein which equivalents are intended to be encompassed by the claims attached hereto.

What is claimed is:

1. A clock assembly comprising:

a primary body having the shape of a type of animal, a front face, a back face, and an opening extending therein from the front face to the back face, wherein the opening has an inner surface configured for selective receipt of a clock;

a base, wherein the base comprises at least one recess configured for selective receipt of at least a portion of the body;

a secondary body having a front face, a back face and a substantially circular opening with an inner surface, wherein at least a portion of the secondary body is secured to at least a portion of the primary body, such that when the primary body and the secondary body are secured together, the substantially circular opening of the primary body and the substantially circular opening of the secondary body are flush with one another;

at least one eyepiece, wherein the eyepiece is secured to at least a portion of at least one of the primary body or the secondary body;

a clock having a clock display and a housing having an outer surface, wherein the outer surface of the housing is mounted inside the inner surface of the opening of the primary body and the inner surface of the opening of the secondary body.

2. The clock assembly of claim 1, further comprising at least one eyepiece, wherein the eyepiece is secured to at least a portion of the body.

3. The clock assembly of claim 1, wherein the at least a portion of the body comprises a bottom portion.

4. The clock assembly of claim 3, wherein the recess is configured for selective receipt of at least a portion of the bottom portion of the body.

5. The clock assembly of claim 1, wherein at least a portion of the back face of the secondary body is secured to at least a portion of the front face of the primary body.

6. The clock assembly of claim 1, wherein the at least one eyepiece is secured to at least a portion of the secondary body.

7. The clock assembly of claim 5, wherein when the secondary body and the primary body are secured together, the inner surface of the substantially circular opening of the primary body and the inner surface of the substantially circular opening of the secondary body are flush with one another.

8. The clock assembly of claim 1, wherein the primary body, the secondary body, and the base are composed of polyethylene.

9. The clock assembly of claim 1, wherein the type of animal is selected from one of a frog, an owl, and a penguin.

10. A kit comprising:

a clock assembly comprising:

a primary body having the shape of a type of animal, a front face, a back face, and an opening extending therein from the front face to the back face, wherein the opening has an inner surface configured for selective receipt of a clock;

a base, wherein the base comprises at least one recess configured for selective receipt of at least a portion of the body;

a secondary body having a front face, a back face and a substantially circular opening with an inner surface, wherein at least a portion of the secondary body is secured to at least a portion of the primary body, such that when the primary body and the secondary body are secured together, the substantially circular opening of the primary body and the substantially circular opening of the secondary body are flush with one another;

at least one eyepiece, wherein the eyepiece is secured to at least a portion of at least one of the primary body or the secondary body;

a clock having a clock display and a housing having an outer surface, wherein the outer surface of the housing is mounted inside the inner surface of the opening of the primary body and the inner surface of the opening of the secondary body;

a container, and a packaging.

* * * * *